US006543890B1

(12) United States Patent
Ylitalo et al.

(10) Patent No.: US 6,543,890 B1
(45) Date of Patent: Apr. 8, 2003

(54) METHOD AND APPARATUS FOR RADIATION CURING OF INK USED IN INKJET PRINTING

(75) Inventors: Caroline M. Ylitalo, Stillwater, MN (US); Ronald K. Thery, New Brighton, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/028,587

(22) Filed: Dec. 19, 2001

(51) Int. Cl.[7] ..... B41J 2/01
(52) U.S. Cl. ..... 347/102
(58) Field of Search ..... 347/102, 101, 347/104, 105, 106, 107, 43, 4; 399/320; 346/25; 219/216; 101/488; 34/304, 381; 516/70; 8/471

(56) References Cited

U.S. PATENT DOCUMENTS

| | | | |
|---|---|---|---|
| 4,774,523 | A | 9/1988 | Beaufort et al. |
| 5,275,646 | A | 1/1994 | Marshall et al. |
| 5,508,826 | A | 4/1996 | Lloyd et al. |
| 5,511,477 | A | 4/1996 | Adler et al. |
| 5,721,086 | A | 2/1998 | Emslander et al. |
| 5,847,743 | A | 12/1998 | Look |
| 5,875,287 | A | 2/1999 | Li et al. |
| 5,981,113 | A | 11/1999 | Christian |
| 6,039,426 | A | 3/2000 | Dobbs |
| 6,082,911 | A | 7/2000 | Murakami |
| 6,092,890 | A | 7/2000 | Wen et al. |
| 6,145,979 | A | 11/2000 | Caiger et al. |

FOREIGN PATENT DOCUMENTS

| | | |
|---|---|---|
| EP | 0 134 591 | 3/1985 |
| EP | 0 658 607 | 9/1998 |
| EP | 0 889 639 | 1/1999 |
| EP | 1 034 936 | 9/2000 |
| EP | 1 108 553 | 6/2001 |
| GB | 2 142 579 | 1/1985 |
| GB | 2 233 928 | 1/1991 |
| GB | 2 322 597 | 9/1998 |
| GB | 2 338 212 | 12/1999 |
| JP | 62109645 | 5/1987 |
| JP | HEI 1-133746 | 5/1989 |
| JP | 02092642 | 4/1990 |
| JP | 6-200204 | 7/1994 |
| JP | 8218016 | 8/1996 |
| JP | 8218017 | 8/1996 |
| JP | 8218018 | 8/1996 |
| JP | 10-207978 | 8/1998 |
| JP | 11-070645 | 3/1999 |
| WO | WO97/04964 | 2/1997 |
| WO | WO97/27053 | 7/1997 |
| WO | WO97/31071 | 8/1997 |
| WO | WO99/08875 | 2/1999 |
| WO | WO99/29788 | 6/1999 |
| WO | WO01/17780 | 3/2001 |

OTHER PUBLICATIONS

Practical Considerations for Using UV Reactive Inks in Piezo DOD Printheads, Richar J. Baker, Spectra Inc., Hanover, New Hampshire, USA, 1999, pp. 111–115.

(List continued on next page.)

*Primary Examiner*—Raquel Yvette Gordon
(74) *Attorney, Agent, or Firm*—James D. Christoff

(57) ABSTRACT

Inkjet printing apparatus includes a print head for directing radiation curable ink onto a substrate and a curing device for directing radiation along a path toward ink received on the substrate. The apparatus includes a shield and a mechanism for selectively moving the shield into and out of the path of radiation. Control of movement of the shield enables the intensity of radiation received on the substrate to be varied to ensure that the substrate does not overheat during a curing operation.

28 Claims, 4 Drawing Sheets

OTHER PUBLICATIONS

Noguchi, Hiromichi, Final Program and Proceedings of IS&T's NIP14: International Conference on Digital Printing Technologies, IS&T—The Society for Imaging Science and Technology, Oct. 1998, UV Curable, Aqueous Ink Jet Ink: Material Design and Performance for Digital Printing, pp. 107–110.

56280US003, U.S. Ser. No. 10/001,101, Filed Nov. 15, 2001.

56281US003, U.S. Ser. No. 10/000,282, Filed Nov. 15, 2001.

56282US003, U.S. Ser. No. 10/001,144, Filed Nov. 15, 2001.

55435US002, U.S. Ser. No. 09/562,018, Filed May 1, 2000.

METHOD AND APPARATUS FOR RADIATION CURING OF INK USED IN INKJET PRINTING

BACKGROUND OF THE INVENTION

1. Field of the Invention

This invention relates to inkjet printing apparatus and methods for inkjet printing using ink that is curable upon exposure to actinic radiation. More particularly, the present invention is directed to methods and apparatus for curing radiation curable ink that has been applied to a substrate by an inkjet printer.

2. Description of the Related Art

Inkjet printing has increased in popularity in recent years due to its relatively high speed and excellent image resolution. Moreover, inkjet printing apparatus used in conjunction with a computer provides great flexibility in design and layout of the final image. The increased popularity of inkjet printing and the efficiencies in use have made inkjet printing an affordable alternative to previously known methods of printing.

In general, there are three types of inkjet printers in widespread use: the flat bed printer, the roll-to-roll printer and the drum printer. In the flat bed printer, the medium or substrate to receive the printed image rests on a horizontally extending flat table or bed. An inkjet print head is mounted on a movable carriage or other type of mechanism that enables the print head to be moved along two mutually perpendicular paths across the bed. The print head is connected to a computer that is programmed to energize certain nozzles of the print head as the print head traverses across the substrate, optionally using inks of different colors. The ink on the substrate is then cured as needed to provide the desired final image.

In roll-to-roll inkjet printers, the substrate to receive the printed image is commonly provided in the form of an elongated web or sheet and advances from a supply roll to a take-up roll. At a location between the supply roll and the take-up roll, a print head is mounted on a carriage that is movable to shift the print head across the substrate in a direction perpendicular to the direction of advancement of the substrate. Known roll-to-roll inkjet printers include vertical printers, wherein the substrate moves in an upwardly direction past the print head, as well as horizontal printers, wherein the substrate moves in a horizontal direction past the print head.

Drum inkjet printers typically include a cylindrical drum that is mounted for rotational movement about a horizontal axis. The substrate is placed over the periphery of the drum and an inkjet print head is operable to direct dots or drops of ink toward the substrate on the drum. In some instances, the print head is stationary and extends along substantially the entire length of the drum in a horizontal direction. In other instances, the length of the print head is somewhat shorter than the length of the drum and is mounted on a carriage for movement in a horizontal direction across the substrate.

Inks that are commonly used in inkjet printers include water-based inks, solvent-based inks and radiation-curable inks. Water-based inks are used with porous substrates or substrates that have a special receptor coating to absorb the water. In general, water-based inks are not satisfactory when used for printing on non-coated, non-porous films.

Solvent-based inks used in inkjet printers are suitable for printing on non-porous films and overcome the problem noted above relating to water-based ink. Unfortunately, many solvent-based inks contain about 90 percent organic solvents by weight. As solvent-based inks dry, the solvent evaporates and may present an environmental hazard. Although environmental systems may be available for reducing the emission of solvents to the atmosphere, such systems are generally considered expensive, especially for the owner of a small print shop.

Furthermore, inkjet printers using either solvent-based inks or water-based inks must dry relatively large quantities of solvent or water before the process is considered complete and the resulting printed product can be conveniently handled. The step of drying the solvents or water by evaporation is relatively time-consuming and can be a rate limiting step for the entire printing process.

In view of the problems noted above, radiation-curable inks have become widely considered in recent years as the ink of choice for printing on a wide variety of non-coated, non-porous substrates. The use of radiation curing enables the ink to quickly dry (commonly considered as "instant" drying) without the need to drive off large quantities of water or solvent. As a result, radiation curable inks can be used in high speed inkjet printers that can achieve production speeds of over 1000 $ft^2$/hr (93 $m^2$/hr.) Inkjet printers that are capable of printing on relatively large substrates are considered expensive. Accordingly, it is desired to use the same printer to impart images to a wide variety of substrates using a wide variety of ink compositions if at all possible. Moreover, it is preferred that each image printed by such printers be of high quality on a consistent basis regardless of the type of substrate and the type of ink used, in view of the time and expense of reprinting the image in instances where the quality of the image is less than desired.

There are a wide variety of curing devices available for hardening radiation curable ink after the ink has been applied to the substrate. For example, ultraviolet ("UV") lamps are often used to cure inks that are curable upon exposure to ultraviolet radiation. However, many lamps that emit ultraviolet radiation also emit significant quantities of heat during operation.

Unfortunately, the presence of excess heat can adversely affect some substrates used in inkjet printing. For example, certain substrates that are relatively thin, such as plasticized cast vinyl films, may begin to soften or melt in the presence of heat from an ultraviolet curing device. It is possible to modify the UV lamp, for example by adding an infrared filter, to reduce the amount of heat reaching the substrate, although such modifications add to the capital cost and may adversely affect the compact design of typical UV lamps used in inkjet devices.

Moreover, many attempts have been made in the past to convert conventional inkjet printers such as inkjet printers using solvent-based ink to inkjet printers that use radiation-curable ink. The cost of such a conversion is not inexpensive but is typically considerably less than the cost of buying a new printer that is specifically manufactured for use with radiation curable inks. The conversion is often carried out by mounting a source of radiation within the cabinet of the printer.

However, space that is available within the cabinets of existing printers is usually limited. Consequently, the radiation source is often mounted by necessity in close proximity to the location of the substrate during a curing operation. The resultant close spacing between the source of radiation and the substrate is often too small to permit the use of certain types of substrates (such as the substrates mentioned above)

that might otherwise begin to soften in the presence of heat from the radiation source.

In view of the foregoing, there is a need in the art for new methods and apparatus for curing radiation curable ink used in an inkjet printing process. Preferably, such a method and apparatus could be used for retrofitting conventional inkjet printers as well as for constructing new printers, and could be used in conjunction with a wide variety of substrates and inks.

SUMMARY OF THE INVENTION

The present invention is directed to inkjet printing apparatus and methods for inkjet printing that employ a shield along with a mechanism for selective movement of the shield. The shield is movable into and out of a path of radiation that extends from a curing device (such as a lamp) to the substrate. The shield enables the amount of radiation reaching the substrate to be precisely controlled so that the likelihood of overheating the substrate is reduced.

In more detail, the present invention is directed in one aspect toward inkjet printing apparatus for radiation curable ink. The apparatus includes a support for receiving a substrate and a print head for directing radiation curable ink onto the substrate. The apparatus also includes a curing device for directing radiation along a path toward ink received on the substrate, and the print head is movable relative to the curing device. The apparatus further includes a shield and a mechanism for selectively moving the shield into and out of the path as may be desired in order to hinder the passage of radiation to ink received on the substrate.

The present invention is directed in another aspect to a method of inkjet printing. The method includes the act of applying a quantity of ink to a substrate using a print head and the act of directing actinic radiation from a curing device along a path toward the ink on the substrate, wherein the print head is movable relative to the curing device. The method further includes the act of selectively moving a shield into and out of the path as may be desired in order to hinder the passage of actinic radiation to the ink on the substrate.

In one embodiment of the invention, the shield comprises a rotatable, cylindrical housing having an elongated opening for selective passage of radiation. In another embodiment of the invention, the shield comprises a reciprocating shutter that is movable between an open and a closed position in order to control the passage of actinic radiation. Preferably, movement of the shield is controlled in accordance with an operational speed of the printer, such as speed of movement of the substrate past the curing device.

These and other aspects of the invention are described in more detail in the paragraphs that follow and are illustrated in the accompanying drawings.

DETAILED DESCRIPTION OF THE PREFERRED EMBODIMENTS

The following examples describe various types of inkjet printing apparatus and printing methods according to the present invention. The accompanying drawings are schematic illustrations selected to highlight certain aspects of the invention. In practice, the concepts described below may be adapted for use with a variety of inkjet printers, including many commercially available inkjet printers.

Examples of suitable rotating drum type inkjet printers include "PressJet" brand printers from Scitex (Rishon Le Zion, Israel) and "DryJet" Advanced Digital Color Proofing System from Dantex Graphics Ltd. (West Yorkshire, UK). Examples of flat bed type inkjet printers include "PressVu" brand printers from VUTEk Inc (Meredith, N.H.) and "SIAS" brand printers from Sias print Group (Novara, Italy). Examples of roll-to-roll inkjet printers include "Arizona" brand printers from Raster Graphics, Inc. of Gretag Imaging Group (San Jose, Calif.) and "UltraVu" brand printers from VUTEk Inc.

Figure 1:
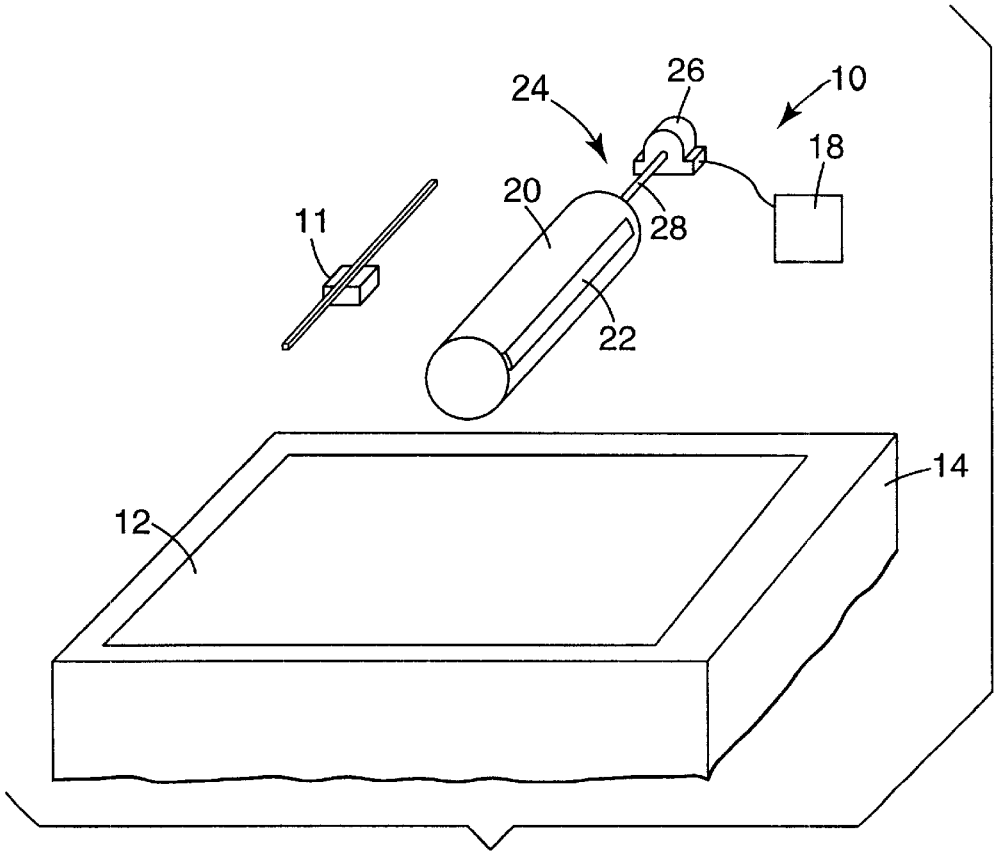
FIG. 1 is a perspective schematic view of an inkjet printing apparatus according to one embodiment of the invention.
Figure 2:
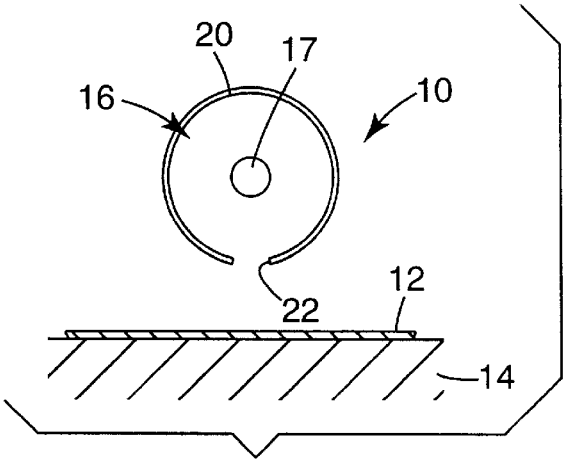
FIG. 2 is a schematic end elevational view of the printing apparatus shown in FIG. 1.

FIGS. 1 and 2 illustrate certain components of an inkjet printing apparatus 10 according to one embodiment of the invention. The apparatus 10 depicted in FIG. 1 is a flat bed inkjet printer, and includes a print head 11. The print head 11 may include a bank of piezo print heads. The number of print heads provided is selected by consideration of various factors, including the total number of colors used in the printer, the type of print head used, and the desired productivity of the printer. A cabinet of the printer is not shown. The printer has a transport system (also not shown) for moving a substrate 12 in a generally horizontal direction as indicated by the arrow in FIG. 1.

The substrate 12 is movable across a horizontally extending support 14 that is shown in FIG. 2. The support 14 supports the substrate 12 during a curing operation. Optionally, the support 14 or an extension of the support 14 holds the substrate 12 during the time that the print head is directing ink to the substrate 12.

The apparatus 10 also includes a curing device 16 for directing actinic radiation along a path toward ink that has been received on the substrate 12. The curing device 16 includes one or more sources of ultraviolet and/or visible radiation. Examples of suitable sources of radiation include mercury lamps, xenon lamps, carbon arc lamps, tungsten filament lamps, lasers and the like. Optionally, the preferred source of UV radiation is a medium pressure mercury lamp equipped with a bulb such as an "H" bulb, "D" bulb or "V" bulb. Preferably, the selected lamps have a spectral output that matches the absorption spectrum of the ink.

The lamps are connected to a controller 18 for timed activation as may be desired. Optionally, the print head 11 is movable toward and away from the curing device 16 in order to vary the dwell time of the ink (i.e., the time interval between the time that the ink is received on the substrate 12 and the time that the ink on the substrate 12 receives actinic radiation.

The apparatus 10 also includes a shield 20 that extends in the path between the curing device 16 and the ink that has been received on the substrate 12. In this embodiment, the shield 20 comprises a housing that surrounds the lamps 17. The housing in the illustrated embodiment has a generally cylindrical shape along with an elongated slit or opening 22. Preferably, the length of the opening is approximately equal to the length of the housing and is parallel to the central axis of the housing.

The shield 20 may optionally include an inner highly reflective surface. As an additional option, the shield may have a shape other than cylindrical. For example, the shield may have a parabolic shape or an elliptical shape in transverse cross-sectional view. Furthermore, a lens may be placed across the opening (such as the opening 22).

Preferably, the lamps 17 extend across a substantial extent of the width of the support 14 so that radiation can be directed in a straight path to ink on the substrate 12 across the substantial extent of the width of the substrate 12. To this end, the curing device 16 may comprise a row of tubular lamps that are placed in end-to-end arrangement. As another alternative, the curing device may comprise a single UV lamp that is mounted on a carriage and can transverse along the width of the substrate 12 independently from the print head 11.

The shield 20 is connected to a mechanism 24 for selective movement. In this embodiment, the mechanism 24 comprises a variable speed electric motor 26 that is connected by a shaft 28 to the shield 20. The motor 26 is electrically connected to the controller 28. Energization of the motor 26 causes the shield 20 to rotate about its central axis. Preferably, the rotational axis of the shield 20 is parallel to the plane of the underlying substrate 12 when the substrate 12 is received on the support 14. Moreover, the rotational axis of the shield 20 is preferably perpendicular to the direction of advancement of the substrate 12.

The controller 18 is operable to vary the speed of the motor 26 for rotation of the shield 20 as desired. In this embodiment, the velocity of the substrate is determined by the selected print mode. Accordingly, for any given print mode, the speed of the transport system and hence the velocity of the substrate 12 is determined, and the rotational speed of the shield 20 is set in accordance with the substrate velocity in order to increase or decrease the curing time (i.e., the length of time that the ink receives radiation from the curing device 16).

Optionally, the width of the opening 22 (i.e., in directions along an arc about the rotational axis of the shield 20) may also be varied so that the amount of radiation directed toward the substrate 12*b* can be changed as desired. The width of the opening 22 may be adjusted manually by provision of one or more sliding covers or plates, or may be adjusted automatically by means of a drive system that moves one or more covers or plates. The drive system, if provided, is preferably electrically connected to the controller 18.

The provision of the shield 20 is an advantage in instances where the space available for placement of a curing device is relatively small. For example, in attempting to retrofit a radiation source curing device into an existing, commercially available printer, the installer may find that the cabinet of the printer includes only a limited amount of available space. In that instance, the shield 20 can function to reduce the intensity of the radiation reaching the substrate 12 so that the latter is not overheated. Such a feature is particularly advantageous in instances where the source of radiation cannot be instantly turned on and off in a satisfactory fashion.

The shield 20 in combination with the controller 18 and the motor 26 is also advantageous in processes where the intensity of radiation reaching the ink is desired to be the same regardless of the speed of the transport system. For example, if the apparatus 10 is operating at a relatively high productivity and the transport system is moving the substrate 12 at a relatively high speed, the controller 18 adjusts the speed of the motor 26 to also operate at a relatively high speed. In other instances when the transport system is advancing the substrate 12 at a relatively slow speed, the speed of the motor 26 is decreased. In this manner, the intensity of radiation reaching the ink on the substrate 12 can be the same regardless of whether the transport system is advancing the substrate 12 at a relatively high speed or a relatively low speed. Optionally, encoders or other types of sensors may be provided to enable the apparatus 10 to determine the position of the shield 20 or the position of the substrate 12 at any point in time.

The apparatus 10 may also optionally include a computer connected to the controller 18. The computer is programmed to determine preferred dwell times for the ink, or the time interval between the time that the ink is received on the substrate 12 and the time that the ink receives radiation from the curing device 16. The dwell time is then set by instructions provided by the computer. Further details of this aspect are described in applicant's co-pending U.S. patent application entitled "METHOD AND APPARATUS FOR INKJET PRINTING USING UV RADIATION CURABLE INK", Ser. No. 10/000,282, filed Nov. 15, 2001 and expressly incorporated by reference herein.

In addition, the apparatus 10 may include automated methods for altering test pattern images that have been received on the substrate 12 for assessing certain characteristics, such as adhesion of a particular ink to a particular substrate. Certain printing parameters are then selected by a computer based on the assessment of the altered test pattern images. Further details of this aspect are described in applicant's pending. U.S. patent application entitled "METHOD AND APPARATUS FOR SELECTION OF INKJET PRINTING PARAMETERS", Ser. No. 10/001144, filed Nov. 15, 2001 and expressly incorporated by reference herein.

A number of other options are also possible. For example, if the support comprises a drum, the drum may be moved by a variable speed drive that is connected to the controller 18.

Figure 3:
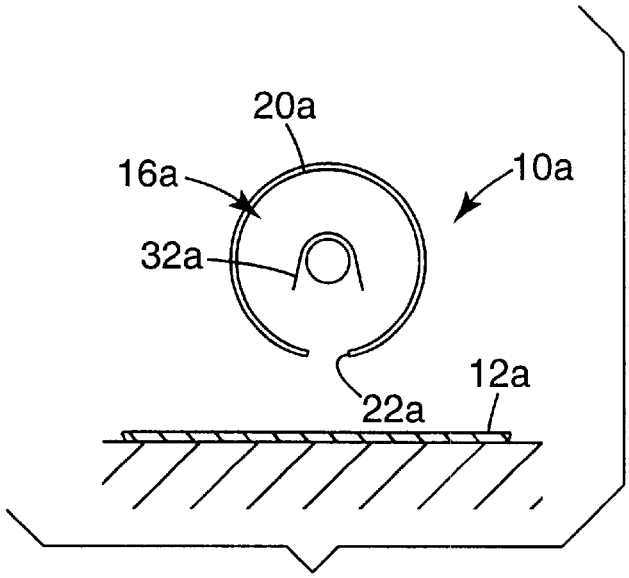
FIG. 3 is a view somewhat similar to FIG. 2 except in accordance with another embodiment of the invention.

An inkjet printing apparatus 10*a* according to another embodiment of the invention is illustrated in FIG. 3. The apparatus 10*a* is essentially identical to the apparatus 10 described above except for the differences that are noted below.

The apparatus 10*a* includes a parabolic reflector 32*a* that is mounted adjacent the lamps of a curing device 16*a*. A shield 20*a*, similar to the shield 20, is rotatable about the reflector 32*a*. The reflector 32*a* rotates with the shield 20*a* in such a manner as to provide focused radiation onto the substrate 12*a* across the width of the opening 22*a* in the shield 20*a*. This configuration results in consistently focused radiation across the entire section of the substrate 12*a* exposed to radiation with each rotation of the shield 20*a*.

The reflector 32*a* also functions to limit the amount of radiation that is emitted in a lateral direction. As a result, the radiation does not pass through the opening 22*a* unless the opening 22*a* is in a certain underlying rotative position to permit the radiation to pass directly beneath the shield 20*a* to the ink on the substrate 12*a* below.

Figure 4:
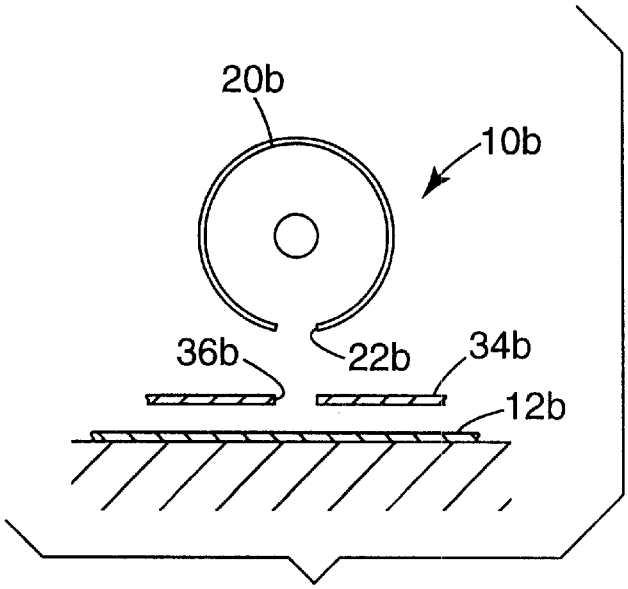
FIG. 4 is a view somewhat similar to FIGS. 2 and 3 except in accordance with yet another embodiment of the invention.

An apparatus 10*b* according to another embodiment of the invention is illustrated in FIG. 4. The apparatus 10*b* is essentially the same as the apparatus 10*a* except for the differences as noted below.

The apparatus 10*b* includes a stationary, elongated barrier 34*b* that extends along the length of a shield 20*b*. The barrier 34*b* includes an elongated rectangular aperture 36*b*. The barrier 34*b* serves as a shield to block passage of actinic radiation to ink on the substrate 12*b* until such time as an opening 22*b* of the shield 20*b* is directly overhead. In this manner, radiation passing through the opening 22*b* does not pass to the ink on the substrate unless the opening 22*b* is aligned with the aperture 36*b*.

Optionally, the barrier 34*b* includes one or more sliding plates or covers adjacent the aperture 36*b*. The sliding plates or covers function to adjust the width of the aperture 36*b* as may be desired. The plates or covers may be adjusted manually, or by provision of a drive system that is connected to a controller (such as a controller similar to the controller 18).

An inkjet printing apparatus 10*c* according to another embodiment is schematically illustrated in FIGS. 5–8. Although not shown in the drawings, the apparatus 10*c* includes a support for receiving a substrate as well as a print head for directing radiation curable ink onto the substrate when the substrate is received on the support.

The apparatus 10*c* also includes a curing device 16*c* having one or more sources of radiation, such as a series of elongated lamps 17*c*. The lamps 17*c* may be similar to the lamps 17 mentioned above. Preferably, the lamps 17*c* extend across the entire width of the substrate during a curing operation so that ink received on the substrate is efficiently cured.

The apparatus 10*c* also includes a shield 20*c* that comprises a pair of shutters 21*c*. The shutters 21*c* are opaque or at least partially opaque to the passage of radiation emitted by the lamps 17*c*. Each of the shutters 21*c* is connected to a pin 23*c* that is pivotally connected to a frame or other structural member of the apparatus 10*c*.

The apparatus 10*c* also includes a mechanism 24*c* for selectively moving the shutters 21*c* between an open position and a closed position. In this embodiment, the mechanism 24*c* comprises two cables 38*c* that are connected to one side of a respective shutter 21*c*. The cables 38*c* extend around a pulley 40*c* and are connected to a plunger of a solenoid 42*c*. In turn, the solenoid 42*c* is electrically connected to a controller 18*c*.

Figure 5:
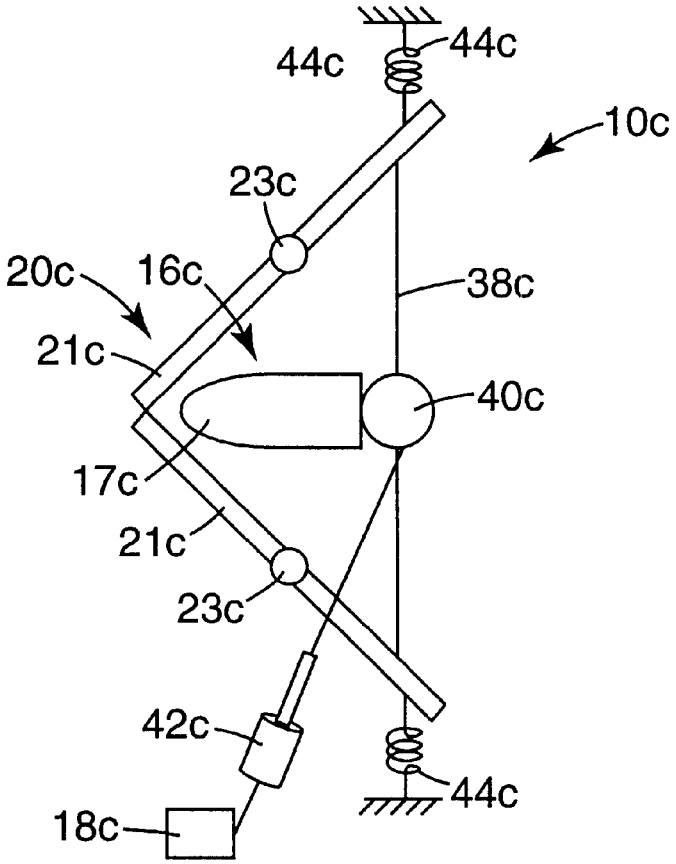
FIG. 5 is a schematic side elevational view of part of an inkjet printing apparatus according to another embodiment of the invention, wherein shutters of the apparatus are depicted in a closed position.
Figure 6:
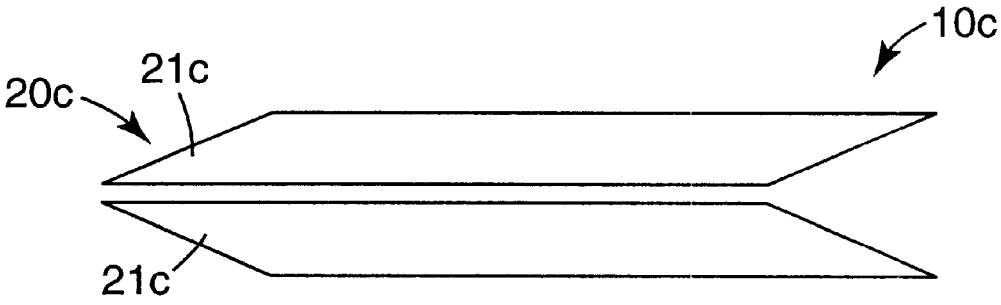
FIG. 6 is a schematic front and side perspective view of the apparatus shown in FIG. 5.

Each of the shutters 21*c* is also connected to one end of one or more springs 44*c* (shown only in FIG. 5). An opposite end of the springs 44*c* is connected to a frame member or other structural member of the apparatus 10*c*. The springs 44*c* have a coiled configuration and function to bias the shutters 21*c* to the normally closed position as shown in FIGS. 5 and 6.

Figure 7:
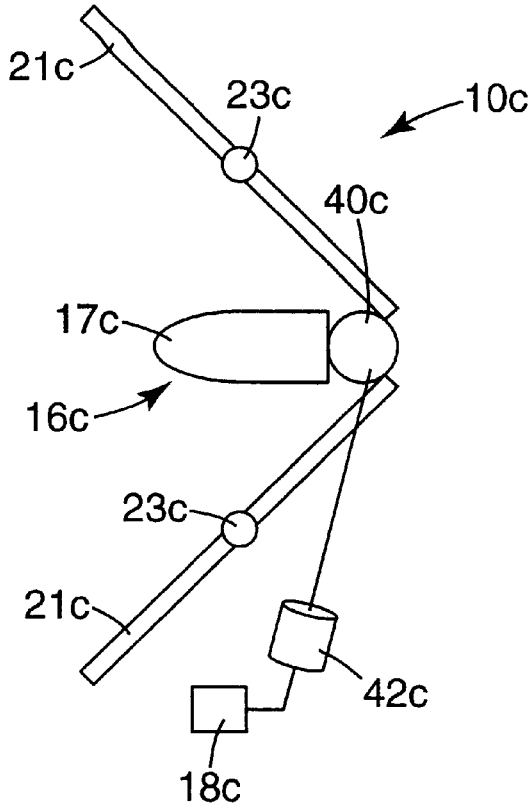
FIG. 7 is a view somewhat similar to FIG. 5 except showing the shutters in an open position.
Figure 8:
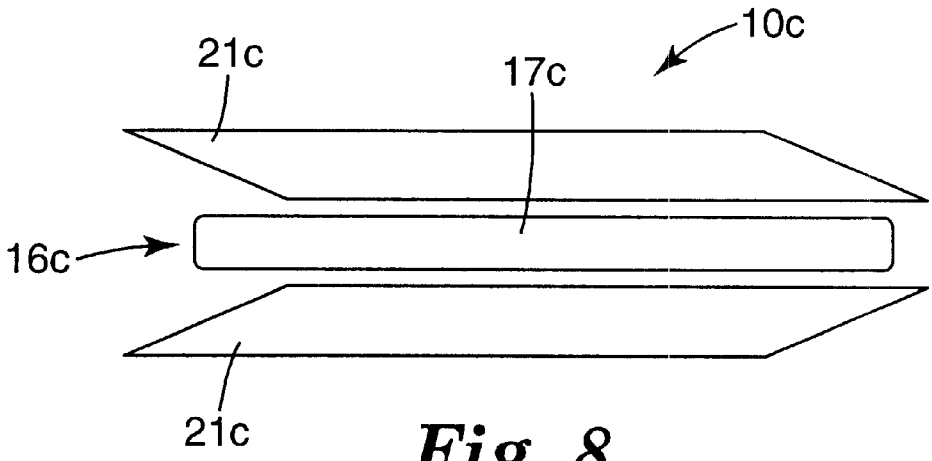
FIG. 8 is a view somewhat similar to FIG. 6 except that the shutters are shown in an open position as depicted in FIG. 7.

When the solenoid 42*c* is energized, the plunger pulls on the cables 38*c* against the bias of the springs 44*c*. The shutters 21*c* then pivot to the open position that is shown in FIGS. 7 and 8. As soon as the solenoid 42*c* is denergized, however, the shutters 21*c* snap back to the closed position shown in FIGS. 5 and 6 due to the tension force exerted by the springs 44*c*.

The controller 18*c* is operable to vary the amount of time that the shutters 21*c* are retained in an open position. Consequently, the total amount of radiation reaching the substrate can be controlled. For example, the amount of radiation can be reduced in instances where the ink cures relatively quickly and/or in instances where the substrate might otherwise overheat. The length of time that the shutters 21*c* are open may also be reduced in instances where the velocity of the substrate passing below the curing device 16 is relatively fast.

Other types of shutters are also possible. For example, the shutters may be retractable and slide back and forth into and out of the path of radiation, instead of moving in the pivoting motion described above. As another alternative, the shutters may fold back into multiple layers out of the radiation path and then unfold to block the radiation.

Other types of mechanisms are also possible. For example, the mechanism could comprise rigid linkages connected to the shutters and movable upon activation of a hydraulic, pneumatic or electric activator.

EXAMPLE

An inkjet printer using radiation curable ink includes a bank of medium pressure mercury lamps such as Fusion brand ultraviolet lamps, catalog no. HP-6, commercially available from Fusion Systems Inc., Gaithersburg, Md. Each lamp provides 475 watts per inch (187 watts per cm.) at 100% power.

The apparatus in this example has a curing device, shield and mechanism similar to the apparatus 10 described above. From the properties of the lamp, a relationship between the speed of the substrate and the radiation dose can be obtained by measuring the dose at various speeds. The relationship for the Fusion brand HP-6 lamp is:

dose=15600/web speed, where the dose is measured in $mJ/cm^2$, and the web speed is measured feet/minute. The dosage can also be calculated by the following equation:

dose=intensity×time, where the intensity of the lamp is 2.2 $watts/cm^2$.

Combining the two equations above allows the optimum window width to be calculated for the chosen lamp. In this case, that value is 1.4 inches (3.56 cm).

The optimum rotational speed of the shield can be calculated for each printing mode according to the following example:

If the printer is operating at a relatively high productivity of 1000 $ft^2/hr$ (93 $m^2/hr$), then the web speed is:

Vmax=2.8 ft/min or 33.6 in/min (85 cm/min).

Also, at Vmax, rotation time=1.4 in/33.6=0.042 minutes per revolution.

From the last two equations, the rotational speed equals 23.8 revolutions per minute.

By contrast, if the printer is operating at a relatively low productivity setting of 260 $ft^2/hr$ (24 $m^2/hr$), then the speed of the substrate is:

Vmin=0.78 ft/min or 9.4 in/min (24 cm/min).

At Vmin, rotation time=1.4 in/9.4=0.15 min/revolution.

Consequently, the rotational speed equals 6.7 revolutions/min.

The embodiments and examples set out above are illustrative of the invention. However, those skilled in the art will recognize that the concepts described above may be modified and/or used with other types of printers without departing from the essence of the invention. For example, the support may be a cylindrical drum or an upright plate instead of a flat bed. Additionally, the curing device may be located in an area remote from the print head, such as over the path of travel of the substrate after it has been released from a cylindrical drum subsequent to receiving ink from a print head.

A number of other alternatives are also possible. Accordingly, the invention should not be deemed limited to the specific embodiments described in detail and shown in the drawings, but instead only by a fair scope of the claims that follow along with their equivalents.

What is claimed is:

1. Inkjet printing apparatus for radiation curable ink comprising:

a support for receiving a substrate;

a print head for directing radiation curable ink onto the substrate;

a curing device for directing radiation along a path toward ink received on the substrate, wherein the print head is movable relative to the curing device;

a shield; and a mechanism for selectively moving the shield into and out of the path as may be desired in order to hinder the passage of radiation to ink received on the substrate.

2. Inkjet printing apparatus according to claim 1 wherein the curing device includes a source of radiation, wherein the shield comprises a housing surrounding the source of radiation, wherein the housing has at least one opening, and wherein the mechanism moves the housing in order to shift the opening and limit the amount of UV radiation passing through the opening.

3. Inkjet printing apparatus according to claim 2 wherein the mechanism rotates the housing about the source of radiation.

4. Inkjet printing apparatus according to claim 3 wherein the housing is cylindrical and the opening comprises an elongated slit.

5. Inkjet printing apparatus according to claim 3 wherein the support comprises a drum that is rotatable about a reference axis and wherein the housing rotates about an axis that is generally parallel to the reference axis.

6. Inkjet printing apparatus according to claim 3 wherein the support extends in a certain reference plane and wherein the housing rotates about an axis that is generally parallel to the reference plane.

7. Inkjet printing apparatus according to claim 6 wherein the apparatus includes a transport system for advancing the substrate along a path in a certain direction, and wherein the housing rotates about an axis that is generally perpendicular to the certain direction.

8. Inkjet printing apparatus according to claim 3 wherein the apparatus includes a controller, wherein the mechanism is connected to the controller, and wherein the controller is operable to vary the speed of rotation of the housing.

9. Inkjet printing apparatus according to claim 3 wherein the apparatus includes a transport system for moving the substrate relative to the print head, and wherein the rotational speed of the housing is varied in accordance with the speed of movement of the substrate.

10. Inkjet printing apparatus according to claim 1 wherein the shield includes at least one shutter that is movable between an open and a closed position in order to selectively hinder the amount of radiation reaching the substrate.

11. Inkjet printing apparatus according to claim 1 wherein each shutter is pivotally movable.

12. Inkjet printing apparatus according to claim 11 wherein the apparatus further includes a solenoid for moving each shutter and a controller connected to the solenoid.

13. Inkjet printing apparatus according to claim 1 wherein the support comprises a bed having a generally flat configuration.

14. Inkjet printing apparatus according to claim 13 wherein the apparatus further includes a transport system for moving the substrate relative to the bed.

15. Inkjet printing apparatus according to claim 14 wherein the apparatus further includes a controller, and wherein the transport system and the mechanism are connected to the controller.

16. Inkjet printing apparatus according to claim 15 wherein the controller varies the speed of movement of the shield in accordance with the speed of movement of the substrate.

17. Inkjet printing apparatus according to claim 1 wherein the apparatus also includes a transport system for relatively moving the substrate and the curing device, wherein the apparatus further includes a controller, and wherein the transport system is connected to the controller.

18. Inkjet printing apparatus according to claim 1 wherein the apparatus includes a controller, and wherein the controller includes a memory that retains one or more characteristics of certain substrates, one or more characteristics of certain inks and/or preferred dwell times when certain combinations of ink and substrates are used.

19. Inkjet printing apparatus according to claim 1 wherein the curing device includes one or more sources of ultraviolet radiation.

20. Inkjet printing apparatus according to claim 1 wherein the shield includes an opening and one or more movable covers for varying the size of the opening.

21. Inkjet printing apparatus according to claim 1 wherein the curing device includes one or more elongated lamps and one or more reflectors adjacent the lamps.

22. A method of inkjet printing comprising:

applying a quantity of ink to a substrate using a print head;

directing actinic radiation from a curing device along a path toward the ink that is received on the substrate, wherein the print head is movable relative to the curing device; and selectively moving a shield into and out of the path as may be desired in order to hinder the passage of actinic radiation to the ink on the substrate.

23. The method of claim 22 wherein the act of selectively moving a shield includes the act of selectively moving a housing having an opening.

24. A method of inkjet printing according to claim 23 wherein the act of moving a housing includes the act of rotating a housing.

25. A method of inkjet printing according to claim 22 wherein the act of selectively moving a shield includes the act of selectively moving one or more shutters.

26. A method of inkjet printing according to claim 25 wherein the act of selectively moving one or more shutters includes the act of pivoting one or more shutters.

27. A method of inkjet printing according to claim 22 and including the act of moving the substrate as the shield is moved.

28. A method of inkjet printing according to claim 27 wherein the speed of movement of the shield is varied in accordance with the speed of movement of the substrate.

* * * * *